US005689917A

United States Patent [19]

St-Germain

[11] Patent Number: 5,689,917

[45] Date of Patent: Nov. 25, 1997

[54] VERTICALLY MOVABLE STAGE ASSEMBLY

[76] Inventor: Daniel St-Germain, 1812, Rang St-Edouard, St-Simon Québec, Canada, J0H 1Y0

[21] Appl. No.: 648,631

[22] Filed: May 13, 1996

[51] Int. Cl.[6] ..... E04H 3/26

[52] U.S. Cl. ..... 52/7; 52/10; 52/65; 52/64; 52/67

[58] Field of Search ..... 52/7, 64, 10, 65, 52/67

[56] References Cited

U.S. PATENT DOCUMENTS

| | | | |
|---|---|---|---|
| 1,616,198 | 2/1927 | Partington | 52/7 |
| 1,922,525 | 8/1933 | Clark | 52/7 |
| 2,142,005 | 12/1938 | Roberts | 52/64 |
| 3,634,985 | 1/1972 | Tipton | 52/64 X |
| 3,798,855 | 3/1974 | Walker | 52/64 X |
| 3,918,225 | 11/1975 | Fisher et al. | 52/7 X |
| 5,468,190 | 11/1995 | McCaffrey | 52/7 X |
| 5,540,052 | 7/1996 | Sieke et al. | 52/7 X |

*Primary Examiner*—Wynn E. Wood
*Assistant Examiner*—W. Glenn Edwards
*Attorney, Agent, or Firm*—Françcois Martineau

[57] ABSTRACT

A circular stage platform capable of accommodating one to four dancers is cyclically, vertically reciprocable, a distance of about three feet within a cage which encloses the dancers, the latter remaining visible to the spectators. The system is used in nightclubs or the like.

5 Claims, 4 Drawing Sheets

VERTICALLY MOVABLE STAGE ASSEMBLY

FIELD OF THE INVENTION

The present invention relates to a stage assembly designed to be used in nightclubs, discotheques and the like.

BACKGROUND OF THE INVENTION

It is known to provide a vertically moveable portion of a large theatre stage. Normally, the front part of a theatre stage can be raised to a position level with its back part when the front part is not required to form a pit to accommodate, for instance, an orchestra for an opera or for a dance performance. Such movable stage systems are very extensive and are not designed to be constantly moved up and down while performers are supported by the same.

OBJECTS OF THE PRESENT INVENTION

It is a main object of the present invention to provide a stage assembly in which the stage platform can be reciprocated in an up-and-down movement while performers stand on the same.

Another object of the present invention is to provide such a stage assembly in which the stage platform and the performers standing on the same are enclosed in a cage through which the performers remain visible to the spectators while performing and while being continuously raised and lowered.

Another object of the present invention is to provide a stage assembly of the character described of simple and inexpensive construction and which is more particularly designed to be used in nightclubs such as discotheques and the like.

SUMMARY OF THE INVENTION

The stage assembly of the invention comprises a base, a stage platform cyclically, vertically movable between an upper and a lower limit position, guide means between said base and said stage platform to guide said stage platform in its vertical movement, and power means located between said base and said stage platform to support said stage platform and effect its cyclical, vertical movement.

Preferably, the assembly further includes a skirt fixed to and depending from said platform, and a casing nested within said skirt and fixed to said base, the guide means being between said skirt and said casing.

Preferably, the assembly further includes a cage secured to said base upstanding from and freely surrounding said stage platform and enclosing performers standing on said stage platform, said cage permitting said performers to be visible therethrough.

Preferably, an enclosure surrounds the skirt and conceals the same when said stage platform is in lower limit position.

Preferably, the upper edge of the enclosure is about level with the platform when the latter is in lower limit position and the cage is fixed to the enclosure and spacedly surrounds the stage platform whereby the skirt becomes more visible with raising movement of the stage platform from its lower limit position. The cage has an access opening for the performers and steps are fixed to the enclosure below the access opening.

Preferably, the platform is circular and the skirt, the casing, the enclosure and the cage are cylindrical.

Preferably, the cage is formed of a series of spaced, vertical bars and a roof is fixed to the upper end of the bars.

Preferably, the guide means include guide shoes carried by the lower portion of the skirt and are inwardly directed and engage the casing.

Preferably, the guide means further include vertical guide rails fixed to the inside of the enclosure and guide wheels are carried by the skirt and engage the guide rails to prevent rotation of the stage platform while allowing its vertical movement.

Preferably, the power means comprise a single acting hydraulic ram which includes a vertical cylinder upstanding from and fixed to the base and a piston rod upstanding from the cylinder and fixed to the underside of the platform and a hydraulic circuit for the ram which includes an electrovalve to admit and exit hydraulic fluid from the bottom of the cylinder.

Preferably, the ram further include a piston with restricted fluid passages coming a register with a bleeding port in said cylinder just before said piston reaches its upper limit position to thus decelerate the platform when attaining its upper limit position.

Preferably, the platform is designed to hold up to four performers such as dancers and the latter are visible to the spectators through the cage.

BRIEF DESCRIPTION OF THE DRAWINGS

In the annexed drawings.

DETAILED DESCRIPTION OF THE PREFERRED EMBODIMENT

Figure 8:
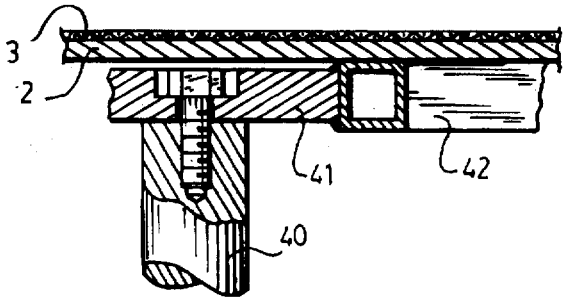
FIG. 8 is a partial section taken in area 8 of FIG. 5.
Figure 9:
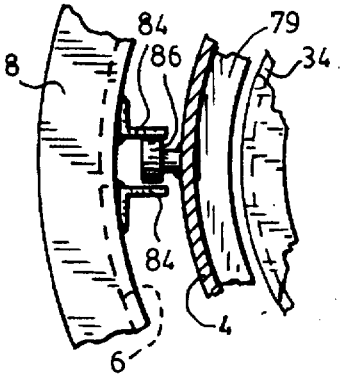
FIG. 9 is a partial plan section taken along line 9—9 of FIG. 5.
Figure 10:
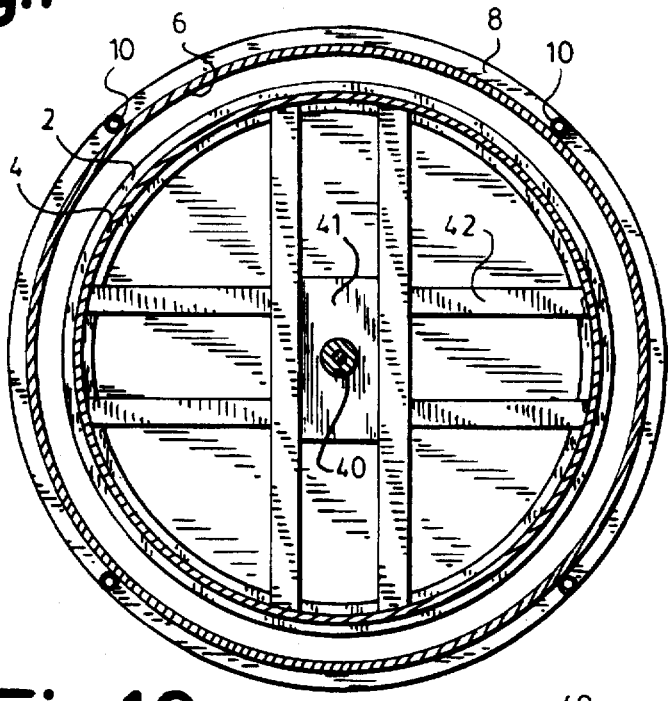
FIG. 10 is a plan section taken along line 10—10 of FIG. 4.

The assembly of the invention comprises a circular stage platform 2 lined with a carpet 3 (FIG. 8) and of a diameter, for instance, of about 40 inches to accommodate normally a maximum of four performers P such as dancers in a disco club. A cylindrical skirt 4 depends from the periphery of the platform 2 and freely nests within a cylindrical enclosure 6. The enclosure 6 has a top flange 8 which is reinforced by vertical reinforcing tubes 10 vertically extending on the outside of enclosure 6, engaging the underside of top flange 8 and resting on ears 12 which radially protrude from a ring 14, the ears 12 and ring 14 resting on the floor and being part of a base 16, the remaining part of said base consisting of a series of square tubes 18 arranged as a cross secured together and secured on top of ring 14 at their outer ends.

A cage 20 forms an upper extension of the enclosure 6; cage 20 consists of series of vertical bars or tubes 22 which are spaced from one another and which are fixed at their lower end to the top flange 8 by means of sockets 24 while their upper ends are fixed to the underside of a circular roof 26.

In practice, in order to stabilize the stage assembly of the invention, the roof 26 is applied against and fixed to the ceiling 28 of the hall or room in which the assembly is located. Cage 20 has an access opening 30 to permit entry and exit of the performers P, the access opening 30 is preferably simply defined by the greater spacing of a selected pair of tubes 22. Steps 32 are fixed to the enclosure 6 just below the access opening 30 to permit the performers to climb onto and descend from the platform 2.

Figure 4:
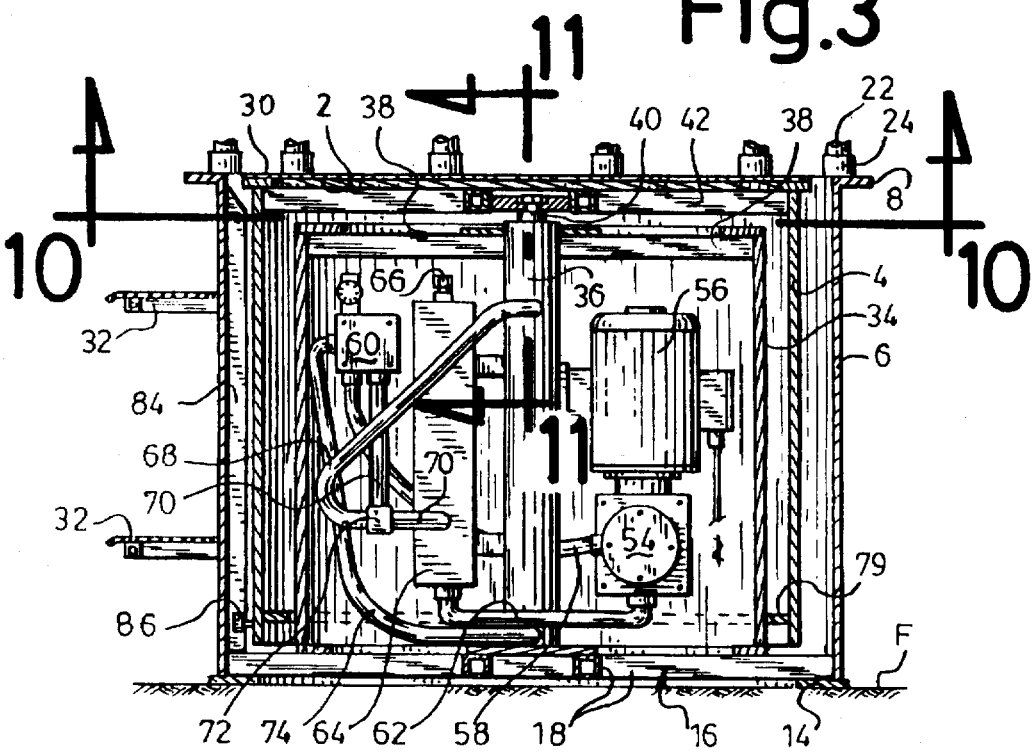
FIGS. 4 and 5 are partial vertical sections taken along line 4—4 of FIG. 3 and showing the platform in lower and upper limit position respectively.
Figure 5:
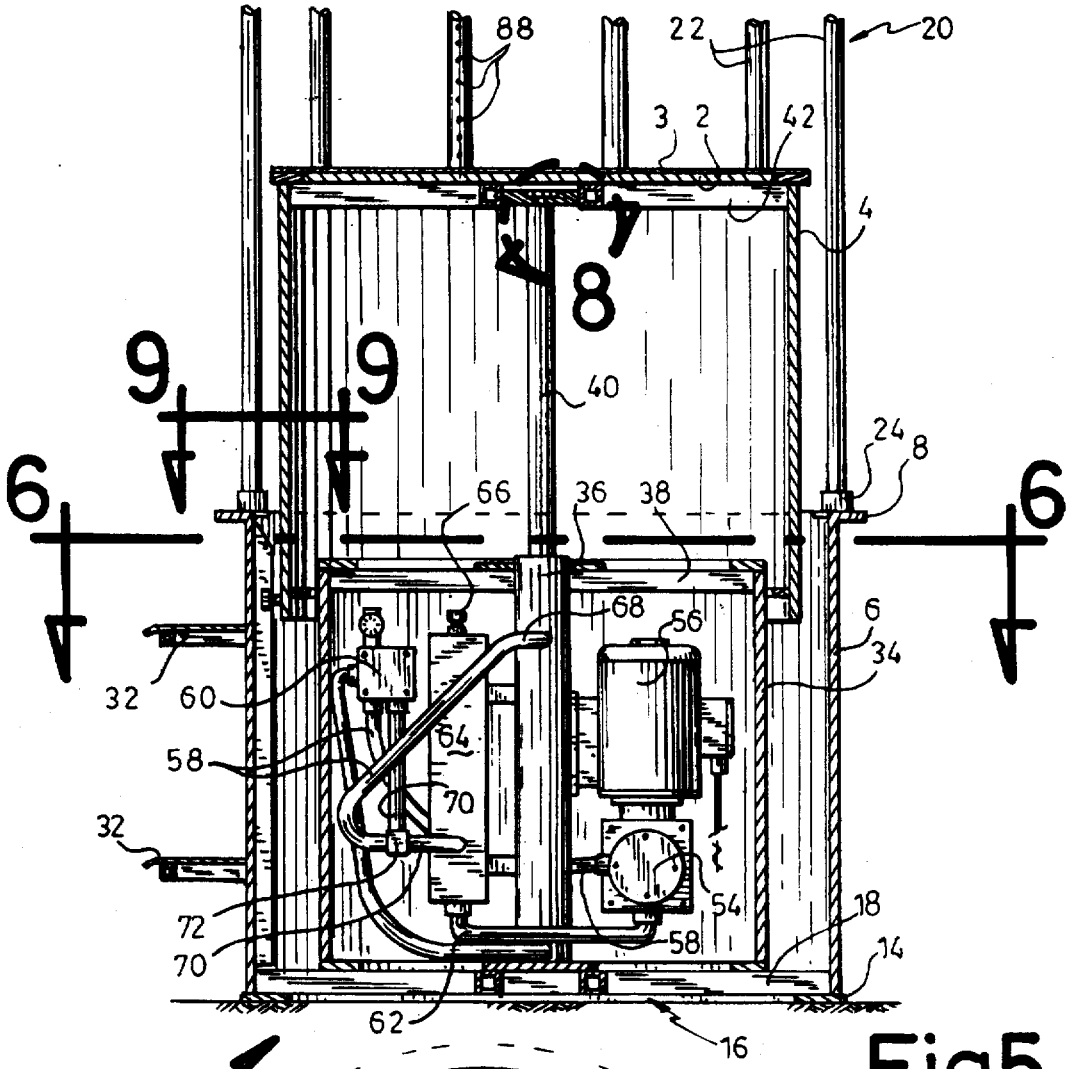
Figure 6:
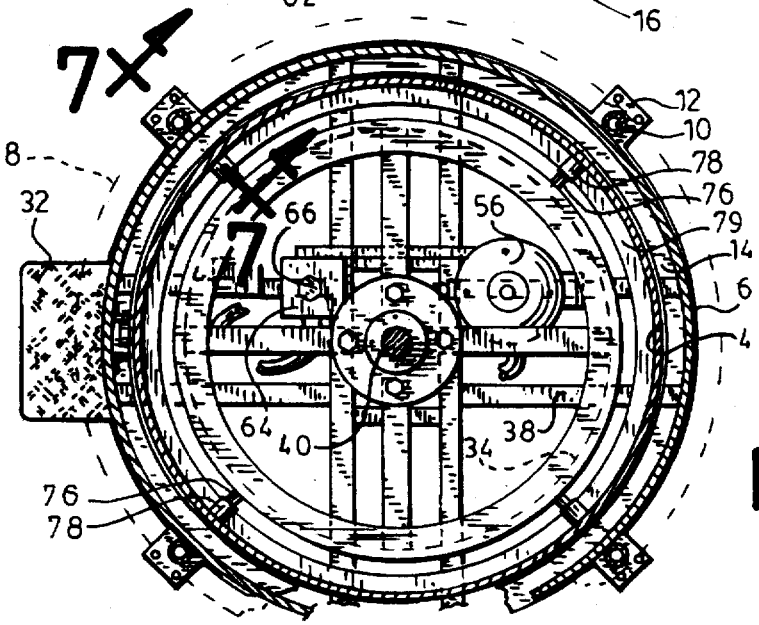
FIG. 6 is a plan section taken along line 6—6 of FIG. 5.

Referring to FIGS. 4 and 5, a cylindrical casing 34 is nested within the skirt 4 and is coaxial therewith and also with enclosure 6. Casing 34 is fixed to base 16.

Figure 1:
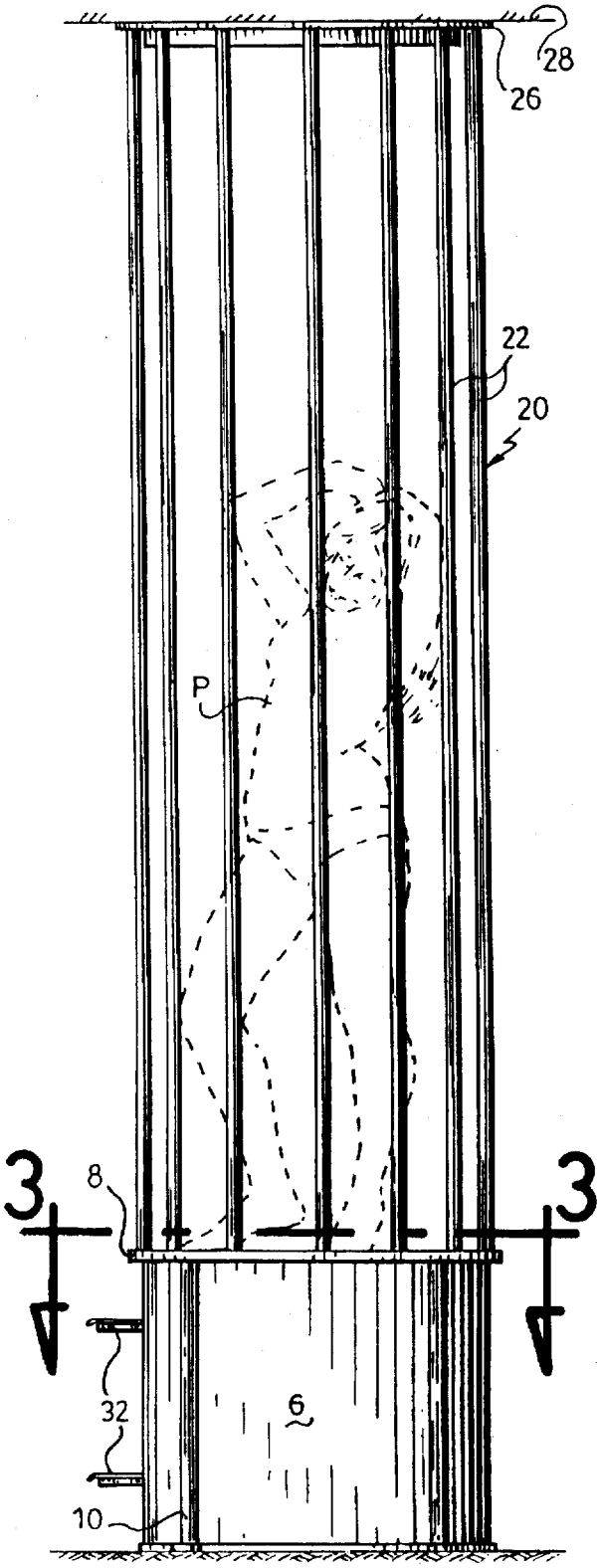
FIGS. 1 and 2 are side elevations of the stage assembly of the invention with the stage platform in lower and upper limit positions respectively.
Figure 2:
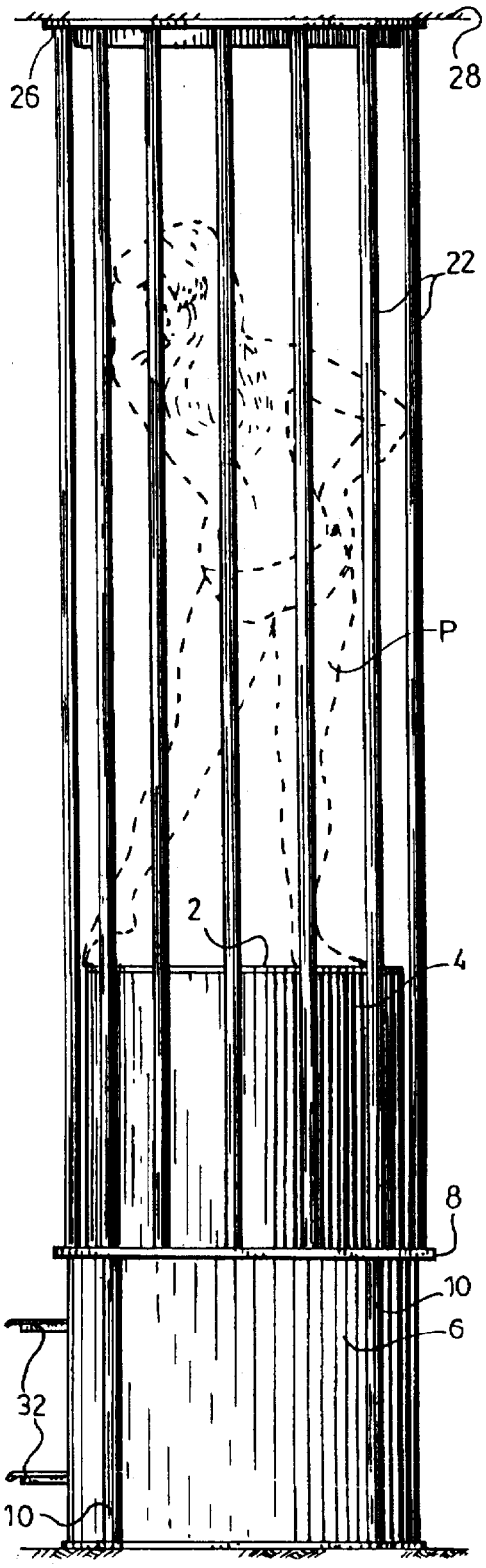
Figure 3:
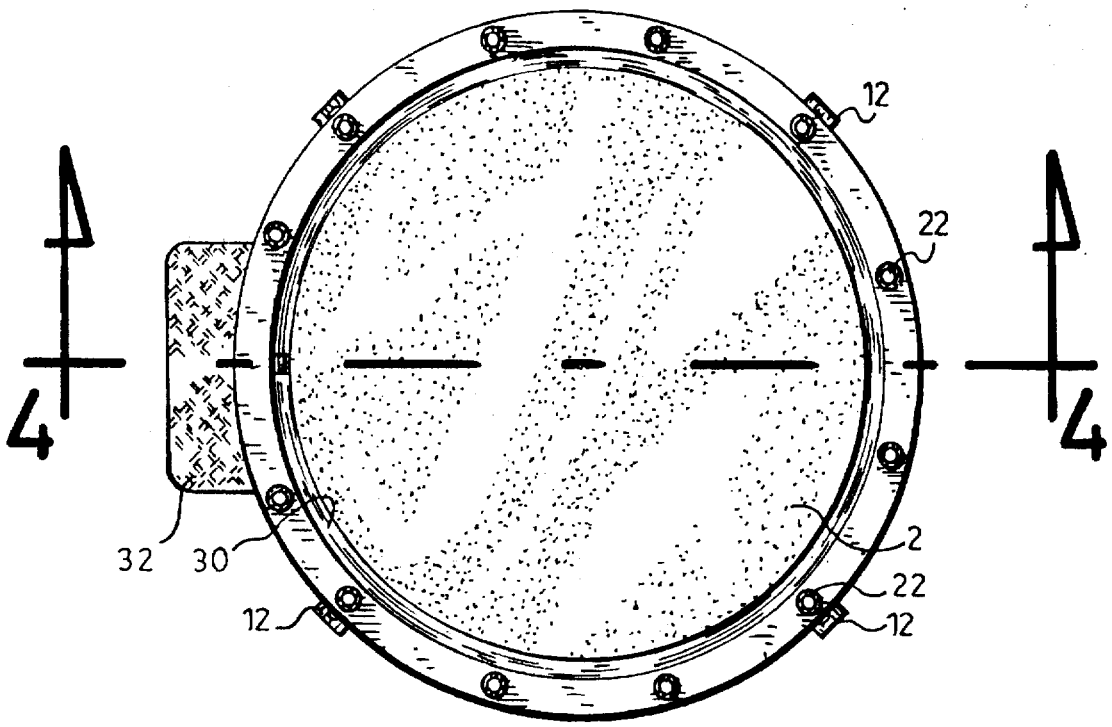
FIG. 3 is a plan section taken along line 3—3 of FIG. 1.

Power means are provided, together with cycling means acting on the power means, to produce reciprocating vertical movement of the platform 2 between the lowermost position of said platform illustrated in FIGS. 1 and 4 in which the platform is about level with the top flange 8 and an uppermost position as shown in FIGS. 2 and 5. These power means include a single acting hydraulic ram composed of a hydraulic cylinder 36 which is vertically disposed and coaxial with casing 34 being secured to base 16 at its lower end and to a framework 38 at its upper end, the framework 38 being in turn secured to the top edge of casing 34.

The hydraulic ram further includes a piston rod 40 which upwardly extends from the top of cylinder 36 and which is secured at its upper end to a plate 41 which is welded to the centre of a framework 42 which extends under and supports and is secured to the platform 2. Skirt 4 is also secured to framework 42.

Figure 11:
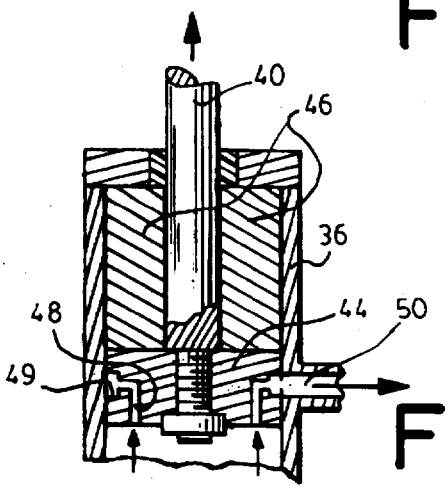
FIG. 11 is a partial vertical section taken along line 11—11 of FIG. 4 and showing the piston of the hydraulic ram in upper limit position.
Figure 12:
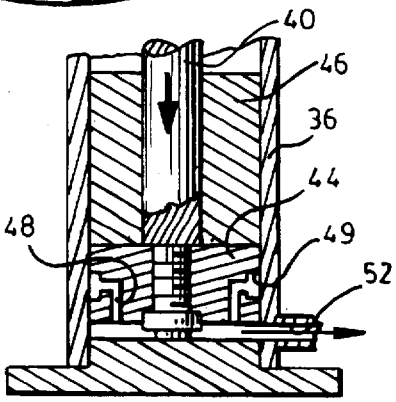
FIG. 12 is a section of the lower portion of the ram and showing the piston in lower limit position.

As shown in FIGS. 11 and 12, the piston rod 40 is secured to a piston 44 and is surrounded by sleeve 46 which has a sliding fit with the cylinder 36. Sleeve 46 helps to prevent flexing of piston rod 40 when piston 44 has reached its uppermost position as shown in FIG. 11. Piston 44 has a plurality of hydraulic fluid restricted passages 48 opening at the underside of the piston and at a peripheral groove 49 which comes in register with a bypass port 50 of cylinder 36 disposed near the upper end of said cylinder. In practice, a small gap is left between the top of sleeve 46 and the top of piston 44 when groove 49 starts to register with the bypass port 50.

The bottom of cylinder 36 has an in-and-out port 52. Cylinder 36 is connected by its ports 50 and 52 in a hydraulic circuit which includes a hydraulic pump 54 driven by an electric motor 56 and connected by an outlet tubing 58 to one port of an electrovalve 60 and by a return tubing 62 to the bottom of a hydraulic fluid reservoir 64 which is adapted to be filled with through a top opening normally closed by a plug 66. A bypass tubing 68 is connected to the bypass port 50 of cylinder 36 and to the bottom of reservoir 64. This bypass tubing 68 is also connected to the electro-valve 60 by tubing 70 by means of a T-coupling 72. An in-and-out tubing 74 connects the in-and-out port 52 of cylinder 36 with the third port of electro-valve 60.

Platform 2 is raised by ram 36, 40, 44 in the following manner: a stage assembly operator, at a distance from the platform 2, actuates by a remote control device the operating switch of the stage assembly power means to the "on" position. The valve electric circuit then feeds with hydraulic fluid the electrovalve 60. The raised platform 2 then progressively lowers under its own weight, while the electric motor 56 remains fully inoperative during platform descent. Once the platform 2 reaches its lowermost limit position, it engages a limit switch, wherein a relay timer is actuated to feed electric current to the electric motor 56. The simple stroke hydraulic pump 54 is then energized, to raise the platform under hydraulic pressure from its lowermost limit position, for a duration e.g. of about 12 to 15 seconds. And the cycle begins a second time.

More particularly, this stage assembly operation is performed by the valve 60 being in a position interconnecting pump outlet tubing 58 with in-and-out tubing 74, hydraulic fluid under pressure being fed by pump 54 to the bottom of cylinder 36 through in-and-out port 52. Piston 44 and consequently platform 2 are raised until passages 48 and groove 49 of piston 44 come in communication with the bypass port 50.

At this point the hydraulic fluid is returned to the reservoir 64 by the bypass tubing 68 whereby the piston speed is decelerated to cushion any piston impact against the top of cylinder when the platform reaches its upper limit position.

The electrovalve 60 is then actuated to change its position, disconnecting tubing 58 from tubing 74 and connecting pump outlet tubing 58 and tubing 74 to the return tubing 70. Therefore, the weight of the performers on the platform causes lowering of the piston 44 and the hydraulic fluid is returned to the reservoir 64 through in-and-out port 52, tubing 74, electrovalve 60 and return tubing 70. FIG. 11 shows the lowermost position of the piston.

Limit switches are connected in the valve electric circuit to operate the electrovalve to automatically alternate the position of the electrovalve spool upon the platform reaching its limit positions. Thus the platform can be reciprocated, for instance, at about three cycles per minute.

In the lowermost position of the platform 2, the same is about level with the top flange 8 of enclosure 6. The platform can be raised to about three feet; the cage 20 is high enough to enclose the performers P, even in the uppermost position of the platform.

It is understood that the platform 2 can be safely stopped at any step of its cycle, to remain at the selected height without danger of accidental fall to the ground, be it at its lowermost limit position, uppermost limit position, or any intermediate position in between, simply by switching to "off" the operating switch of the power means of the stage assembly.

Figure 7:
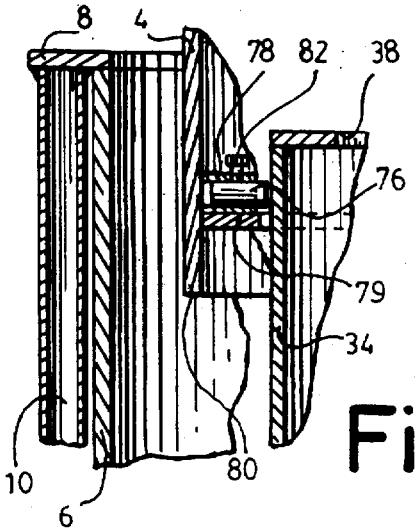
FIG. 7 is a partial vertical section taken along line 7—7 of FIG. 6.

Guide means are provided to prevent tilting of platform 2 when subjected to an eccentric downward force. These guide means include guide shoes 76 (see FIGS. 4, 5 and 7) which are fitted within sockets 78 secured to a ring 79 which is fixed to the inside of skirt 4 near the bottom edge 80 thereof. Guide shoes 76 are radially inwardly extending from skirt and adjusted by set screws 82 to have a sliding fit with casing 34.

Since skirt 4 is preferably cylindrical, the guide means also preferably include means to prevent rotation of platforms 2 and skirt 4 about the axis of cylinder 36. These means include pairs of vertical guide rails 84 secured to the inside of enclosure 6 and each pair receiving a guide wheel 86 carried by the outside of skirt 4 at the level of guide shoes 76.

Preferably, an electronic circuit is provided to operate electric motor 56 at a variable speed and electrovalve 60 from a remote location to thus permit a controller to reciprocate the platform at a desired variable cycling speed and also to operate, if necessary, strobe lights which can be attached to the roof 26 to illuminate the performers P. One or more of the tubular bars 22 constituting the cage 20 can be perforated as shown at 88 in FIG. 5 and connected to a supply of smoke also remote controlled by the controller.

I claim:

1. A mobile self-standing stage unit comprising:

a) a main ground-engaging casing, defining a flooring member, freely engageable over ground, an integral peripheral upstanding wall having a top edge, and a access opening circumscribed by an upright wall top edge;

b) a ram member, defining a cylinder section, fixedly mounted in upright position to said casing flooring member, and a piston section defining an inner section, slidingly engaged into said cylinder section, and an outer end;

c) a platform, having an underface with a central area transversely anchored to said piston outer end of said ram member, and an opposite top face adapted to stably support at least one performer spacedly over ground, said platform template being diametrally smaller than said casing access opening;

d) hydraulic power means, carried within said casing and operatively connected to said ram member for continuous, long-lasting, up and down reciprocating motion of said platform over said main casing;

e) a number of upright post members defining top and bottom ends, said post members fixedly mounted at their bottom ends to said main casing upright wall top edge and fixedly connected at their top ends to a transverse top panel, wherein an open upright see-through cage is formed over said casing, said platform freely reciprocatable under power from said hydraulic power means through a lower section of said cage between a first downward limit position, approximately within said casing access opening, and a second upward limit position, intermediate said casing accessing opening and said top panel, so that a performer supported by the platform may move up and down therewith without contacting said top panel; wherein said mobile stage unit is destined to be freely mounted in upright condition over ground spacedly under the room ceiling and to be completely portable and freely movable as a single unit from one location to another, without special tools nor skilled labour and without modification to the ground surface.

2. A mobile stage unit as in claim 1, wherein said platform is anchored orthogonally to said ram member piston outer end, and defines a peripheral edge section and further includes an annular rigid skirt integrally downwardly depending from said peripheral edge section thereof orthogonally thereto, said annular rigid skirt defining a bottom access opening and being slightly diametrally smaller than said casing but being longer than said ram member piston section so as to engage therein at least partially in whatever extended position of the piston section relative to the cylinder section, whereby said skirt becomes gradually more visible through said cage with raising movement of said platform from its lower limit position to its upper limit position.

3. A mobile stage unit as in claim 2, further including:

a sub-casing defining a flooring, integrally mounted to said main casing flooring member, an integral upstanding peripheral wall, enclosing said hydraulic power means and ram member, and a access opening, said peripheral wall diametrally smaller than said rigid skirt and said sub-casing top mouth being engaged by at least a fraction of said rigid skirt; and guide means, mounted to said casing peripheral wall top edge and cooperating with said rigid skirt to guide said rigid skirt axially between said main casing peripheral upstanding wall and said sub-casing peripheral upstanding wall and to concurrently guide said platform in its vertical motion and in compensating for accidental off-axis loads being applied to said ram member piston section as the latter extends from said cylinder section as the performer moves over said platform away from said central area thereof.

4. A mobile stage unit as in claim 3, wherein said guide means includes guide shoes carried by the lower portion of said rigid skirt and being inwardly directed and engaging said sub-casing peripheral upstanding wall, and vertical guide rails fixed to said main casing peripheral upstanding wall and guide wheels carried by said skirt and engaging said guide rails to prevent rotation of said platform while allowing its vertical movement.

5. A mobile stage unit as in claim 1, wherein said hydraulic power means includes an electrovalve, to admit and exit pressure fluid into and from the bottom of said cylinder section, and fluid passages into the piston section coming in register with a bleeding port in said cylinder section just before said piston section reaches the upper limit position of the platform to decelerate said platform when attaining its upper limit position; wherein said hydraulic power means provides smooth joltless platform motion as the ram member piston section stops to shift from extension to retraction and from retraction to extension relative to the ram member cylinder section, during reciprocating motion thereof.

* * * * *